US005806289A

United States Patent [19]

Sassi et al.

[11] Patent Number: 5,806,289

[45] Date of Patent: Sep. 15, 1998

[54] CONTINUOUS CIGARETTE PACKING MACHINE

[75] Inventors: Fabio Sassi, Imola; Fiorenzo Draghetti, Medicina, both of Italy

[73] Assignee: G.D Societa' Per Azinoni, Bologna, Italy

[21] Appl. No.: 601,718

[22] Filed: Feb. 15, 1996

[30] Foreign Application Priority Data

Feb. 21, 1995 [IT] Italy ..... BO95A0058

[51] Int. Cl.[6] ..... B65B 49/00

[52] U.S. Cl. ..... 53/575; 53/234; 493/163; 493/164

[58] Field of Search ..... 493/163, 910, 493/911, 164; 53/228, 234, 210, 148, 575

[56] References Cited

U.S. PATENT DOCUMENTS

| | | | |
|---|---|---|---|
| 3,136,104 | 6/1964 | Geer | 53/234 |
| 3,982,375 | 9/1976 | Focke | 53/228 |
| 4,735,032 | 4/1988 | Focke | 53/149 |
| 4,838,846 | 6/1989 | Focke et al. | 53/234 |
| 4,852,335 | 8/1989 | Focke et al. | 53/575 |
| 5,003,755 | 4/1991 | Draghetti | 53/234 |
| 5,014,490 | 5/1991 | Focke et al. | 53/234 |
| 5,544,467 | 8/1996 | Focke | 53/234 |

*Primary Examiner*—John Sipos
*Assistant Examiner*—Gene L. Kim
*Attorney, Agent, or Firm*—Marshall, O'Toole, Gerstein, Murray & Borun

[57] ABSTRACT

A packing machine presenting a wrapping conveyor for continuously feeding a succession of wrapping spindles along a given path; a feed device for continuously feeding a succession of sheets of wrapping material in a direction tangent to the path, along the path and in time with the spindles; and a pickup device associated with each spindle, and for gripping a front portion of a relative sheet and inserting the front portion between two successive spindles so as to fold an intermediate portion of the sheet about the rear spindle; a retaining member, associated with each spindle, cooperating with the intermediate portion of the relative sheet to retain it on the relative rear spindle and on the wrapping conveyor.

19 Claims, 6 Drawing Sheets

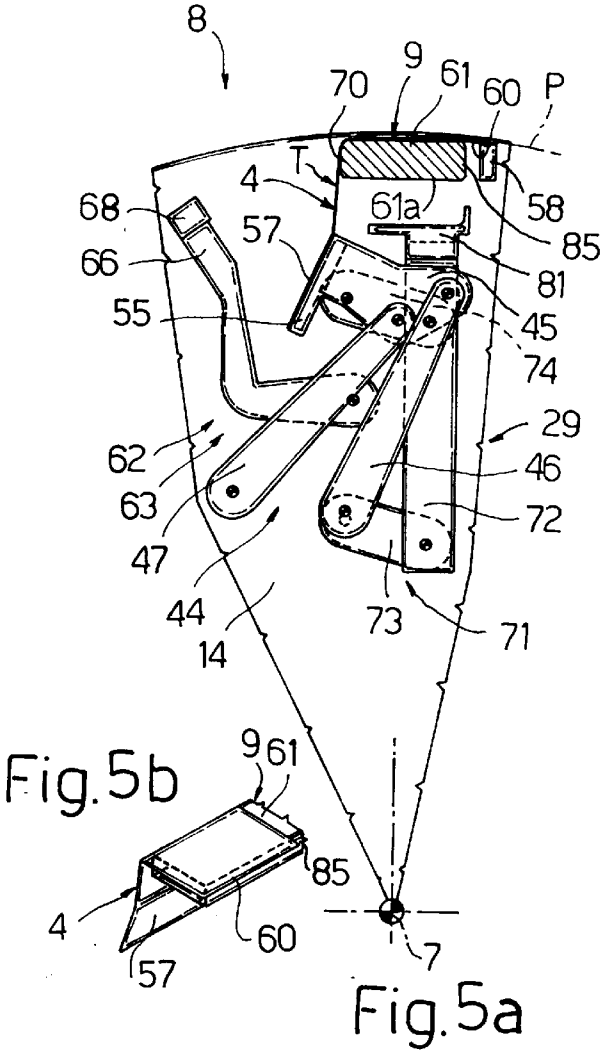
Fig.5a
Fig.5b
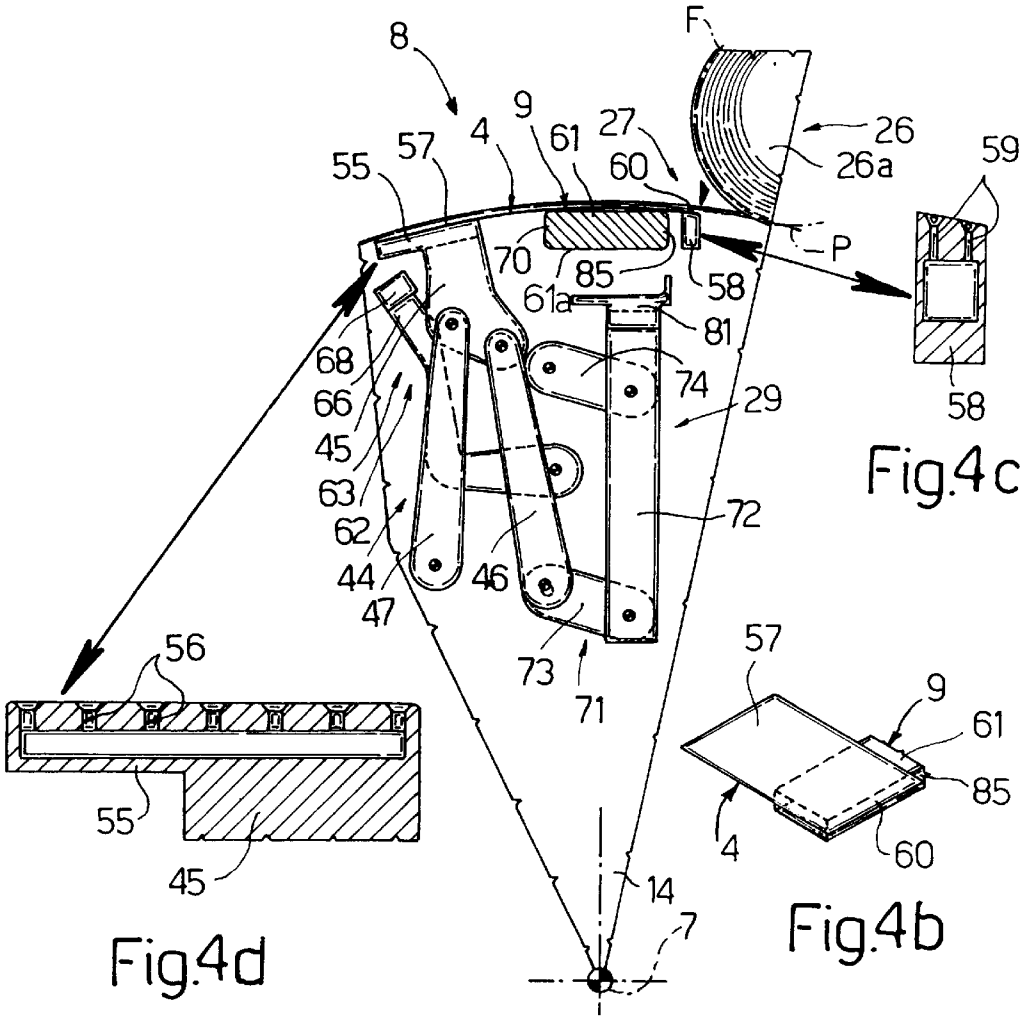
Fig.4c
Fig.4b
Fig.4a
Fig.4d

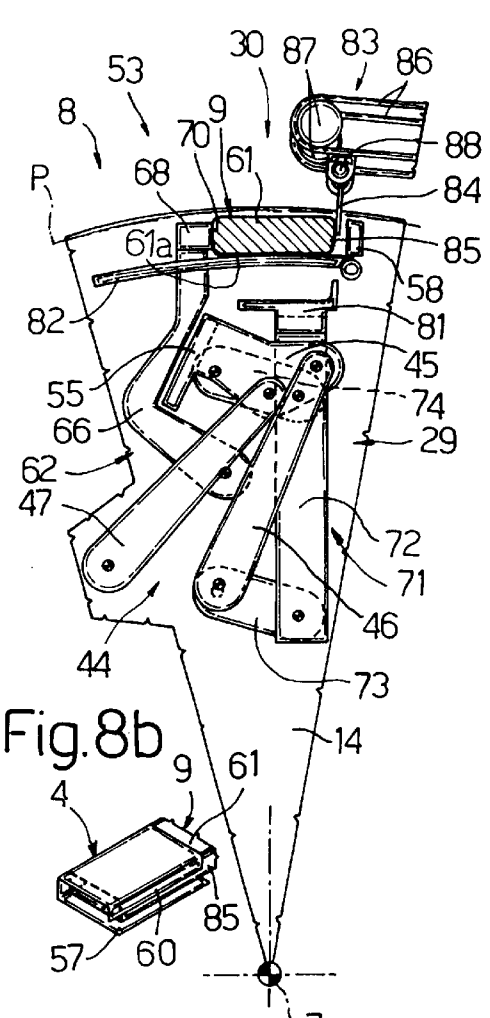
Fig.8a
Fig.8b
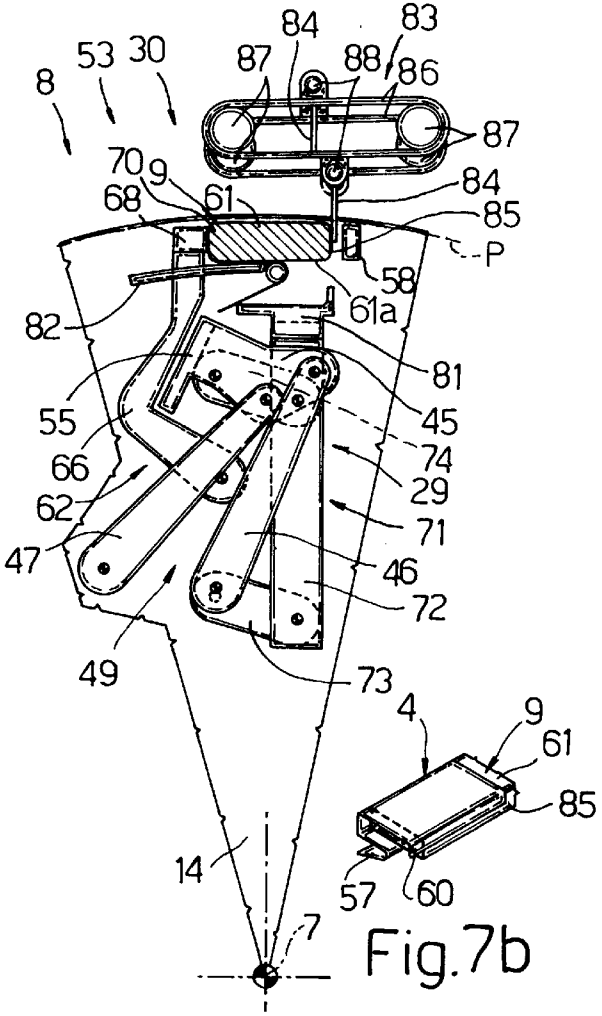
Fig.7a
Fig.7b
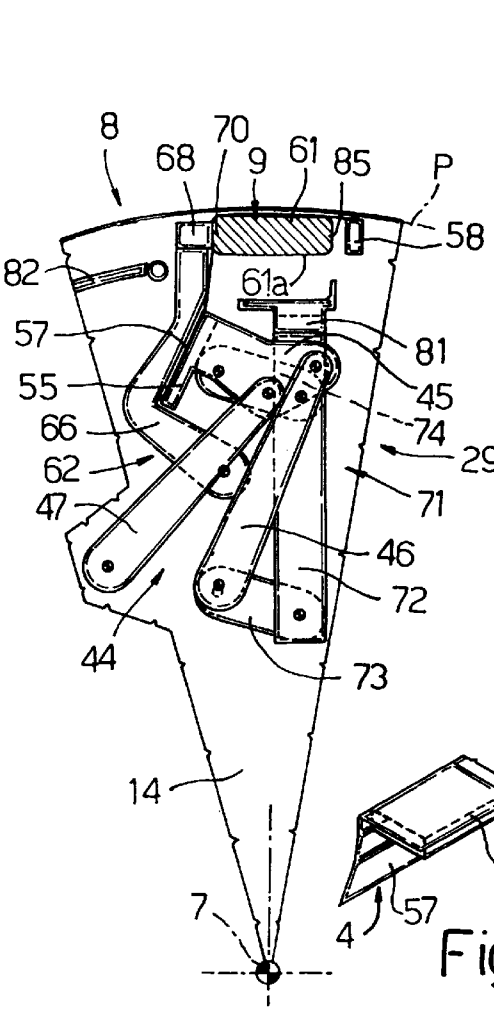
Fig.6a
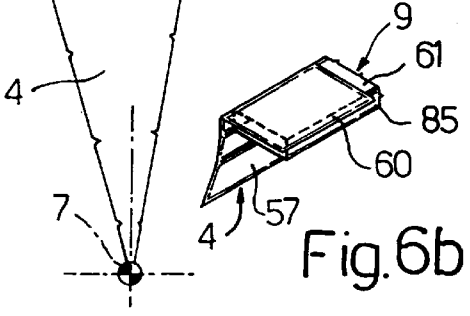
Fig.6b

CONTINUOUS CIGARETTE PACKING MACHINE

BACKGROUND OF THE INVENTION

The present invention relates to a continuous cigarette packing machine.

Patent DE-A-35 27 741 relates to a cigarette packing machine wherein a pocket conveyor device is fed past the output of a cigarette feedbox by which it is supplied successively with groups of cigarettes which are then fed to respective folding spindles fed along an annular path by a wrapping wheel rotating about an axis. As it travels along said path, each spindle is supplied by a feed device with a respective sheet of wrapping material, which is folded about the spindle to form a tubular wrapping.

The above packing machine is a substantially discontinuous type, i.e. wherein a step drive device operates both the pocket conveyor and the device for feeding the sheets of wrapping material onto the wrapping wheel, while a continuous drive device imparts a substantially constant angular speed to the wrapping wheel. The pocket conveyor travels in steps at the station in which the groups are transferred to it from the feedbox, whereas, being connected to the wrapping wheel, the pocket conveyor travels continuously at the station in which the groups are transferred from it to the wrapping wheel.

Known packing machines of the above type present several drawbacks, mainly due to the combined intermittent and continuous movements involved, which result in severe vibration of the machine and, hence, a high noise level and a relatively poor degree of reliability.

SUMMARY OF THE INVENTION

It is an object of the present invention to provide a packing machine featuring a wrapping wheel rotating at substantially constant speed, but designed to overcome the aforementioned drawbacks.

According to the present invention, there is provided a continuous cigarette packing machine comprising a first wrapping conveyor; a succession of wrapping spindles fitted to the first conveyor and movable continuously with the first conveyor along a first given path; a continuously-moving second feed conveyor for feeding a group of cigarettes to each said spindle at a first transfer station along said first path; a feed device for feeding each said spindle with a sheet of wrapping material along a second path and at a second transfer station along said first path; and pickup means associated with each spindle, and for gripping a respective sheet at said second transfer station; characterized in that said second path extends tangentially to the first path at the second transfer station; the feed device comprising continuously-moving conveying means for feeding a succession of sheets of wrapping material to said second transfer station in time with the spindles; said pickup means comprising gripping means for gripping a respective sheet of wrapping material, and actuating means connected to and for moving said gripping means at least partly about the relative spindle; and a retaining member, fitted to the first conveyor and associated with each spindle, cooperating with an intermediate portion of the sheet to retain it on the relative spindle and on the first conveyor.

BRIEF DESCRIPTION OF THE DRAWINGS

A non-limiting embodiment of the present invention will be described by way of example with reference to the accompanying drawings, in which:

FIGS. 4*a*–4*d* , 5*a*–5*b*, 6*a*–6*b* 7*a*–7*b*, 8*a*–8*b*, 9*a*–9*b*, 10*a*–10*b*, and 11*a*–11*b* show the FIG. 3*a*–3*c* details in various operating positions.

DETAILED DESCRIPTION OF THE INVENTION

Figures 1A, 1B, 1C:
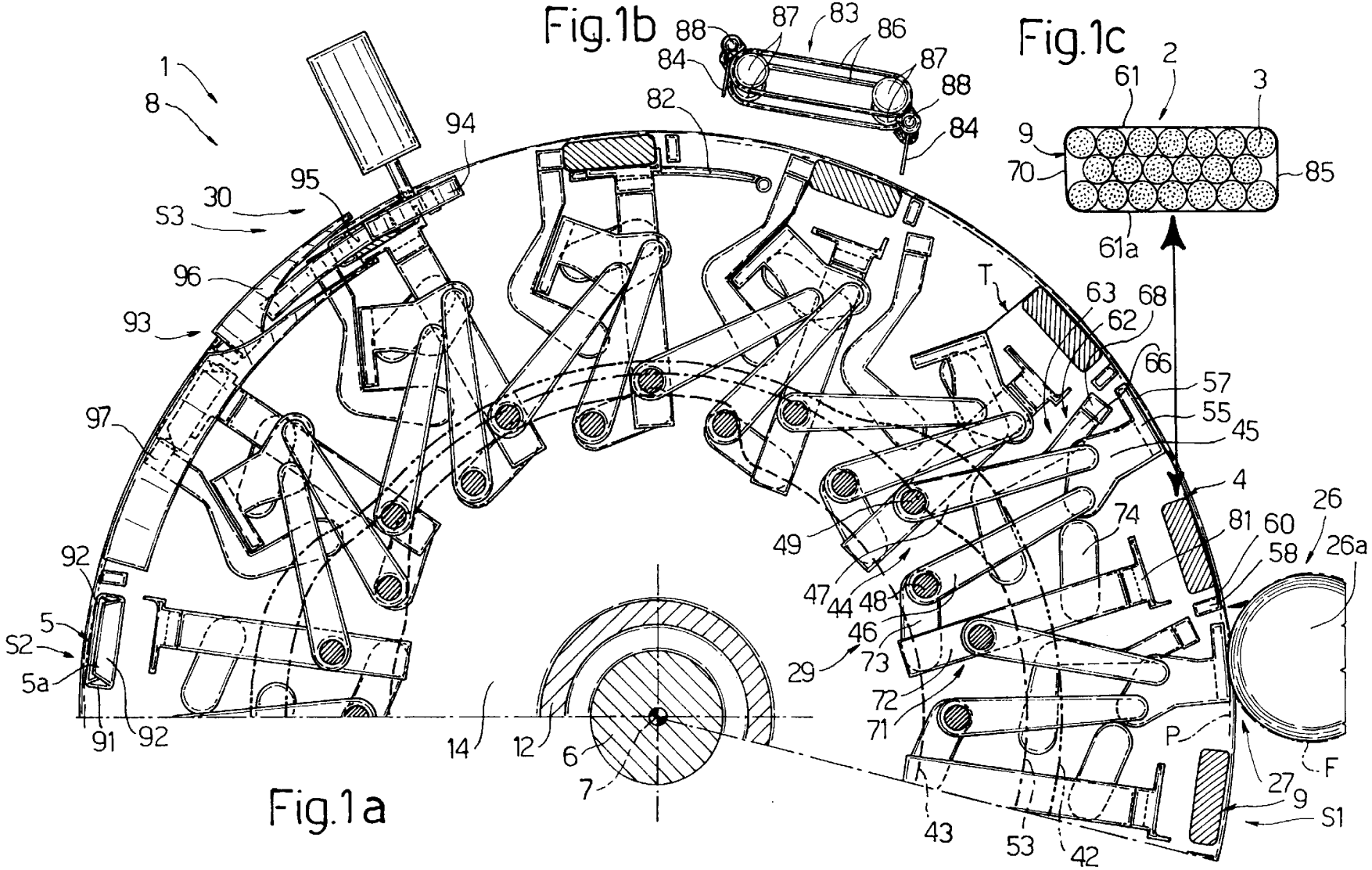
FIGS. 1A–1C shows a side view, with parts in section and parts removed for clarity, of a first preferred embodiment of the machine according to the present invention.
Figure 2:
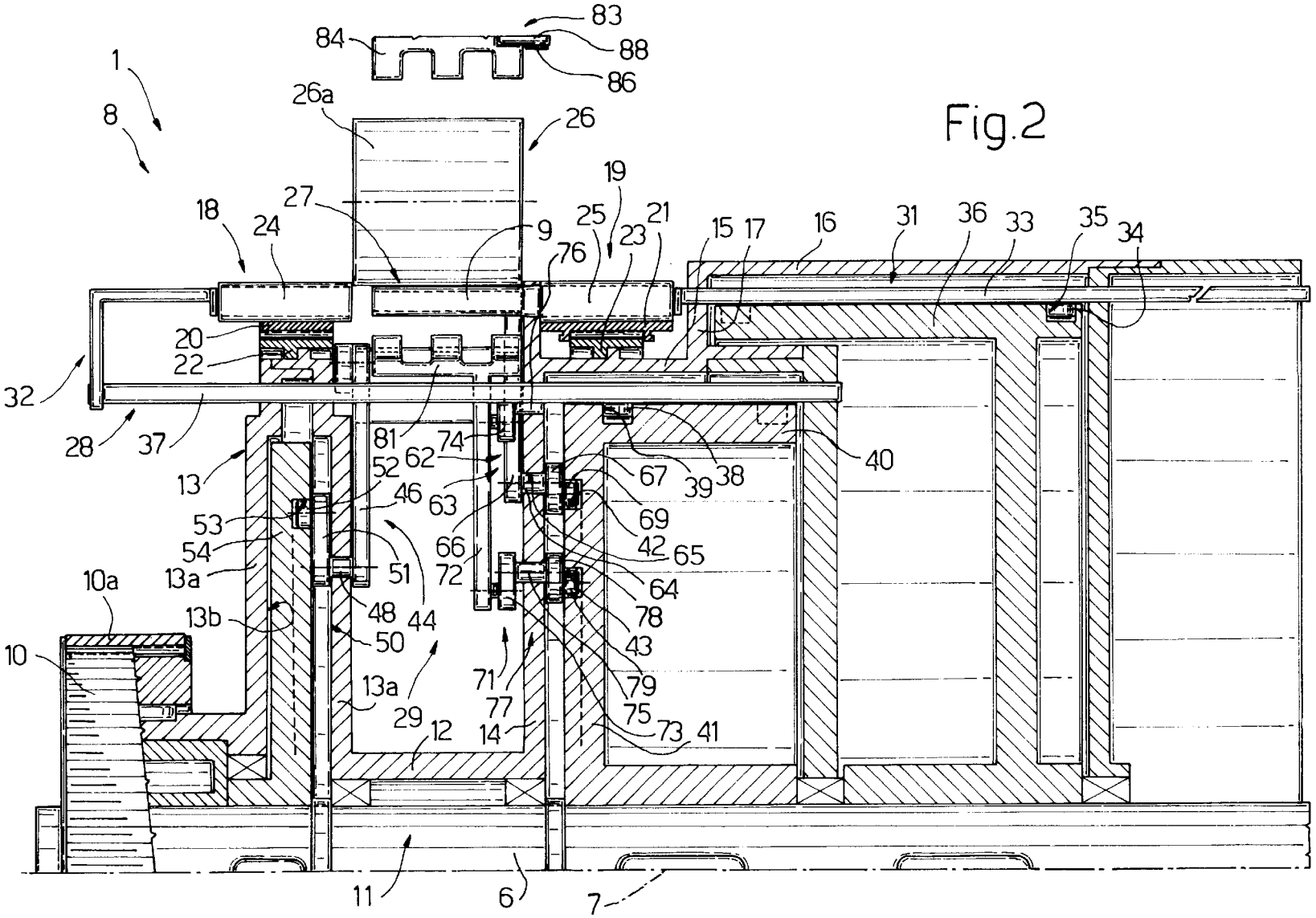
FIG. 2 shows an axial section of a detail in FIG. 1.

Number 1 in FIGS. 1 and 2 indicates a continuous packing machine for packing groups 2 of cigarettes 3, and for forming, about each group 2 and from a sheet 4 of wrapping material, preferably foil, a tubular cup-shaped wrapping 5 presenting an end wall 5*a* crosswise to cigarettes 3.

Machine 1 comprises a known supporting frame (not shown); a fixed supporting shaft 6 extending transversely from said frame and presenting a substantially horizontal axis 7; and a wrapping wheel 8 in turn comprising a number of peripheral pockets or spindles 9 equally spaced about axis 7. Wheel 8 is fitted in rotary manner to shaft 6, and is connected integral with a drive pulley 10 fitted in rotary manner to the free end of shaft 6 and driven by a toothed belt 10*a* connected to a known motor (not shown). Pulley 10 provides for rotating wheel 8 anticlockwise (in FIG. 1) about axis 7 at substantially constant angular speed, to feed spindles 9 along a substantially circular path P.

Wheel 8 also comprises a central drum 11 in turn comprising a central sleeve 12 fitted in rotary manner to shaft 6 via the interposition of bearings, and two annular, substantially circular flanges 13, 14 extending outwards from opposite ends of sleeve 12. Flange 13 is connected integral with pulley 10, and comprises two annular lateral walls 13*a* defining a cylindrical inner chamber 13*b* coaxial with axis 7; and flange 14 is fitted along its outer periphery with spindles 9 projecting from flange 14 towards flange 13. Drum 11 also comprises a first and second tubular appendix 15, 16 extending coaxially with axis 7. More specifically, appendix 15 presents a radius smaller than that of appendix 16 and substantially equal to that of flange 13, is connected integral at one end with flange 14, and presents a free end portion extending inside appendix 16 which, on the end facing flange 14, presents an inner annular flange 17 for connecting appendix 16 to an intermediate point of appendix 15.

Machine 1 also comprises two pocket conveyors 18, 19, in turn comprising respective belts 20, 21 looped about respective pulleys 22, 23 fitted respectively to flange 13 and appendix 15. More specifically, conveyor 18 presents a number of pockets 24 aligned with respective spindles 9 along the arc of tangency between belt 20 and pulley 22; and conveyor 19 presents a number of pockets 25 for transporting respective groups 2, and aligned with respective spindles 9 along the arc of tangency between belt 21 and pulley 23.

Machine 1 also comprises a feed device 26 for supplying sheets 4, and which is located in a fixed position outside wheel 8, and provides for successively and continuously feeding sheets 4, duly spaced, along a substantially circular path F tangent to path P at a station 27 at which sheets 4 are fed onto wheel 8. More specifically, feed device 26 comprises a revolving drum 26*a* with its periphery substantially tangent to the outer periphery of wheel 8, and which provides for feeding sheets 4 along path F, and is driven by a known drive device (not shown) in time with wheel 8, so that each sheet 4 is fed tangentially to wheel 8.

Wheel 8 comprises a transfer unit 28 for successively transferring groups 2 from pockets 25 to spindles 9 at a first transfer station S1, and groups 2 and respective wrappings 5 from spindles 9 to pockets 24 at a second transfer station S2; a folding unit 29, for each spindle 9, fitted to flanges 13 and 14 and rotating about axis 7 together with wheel 8; and a further folding unit 30 fixed along the periphery of drum 11 downstream from station 27, and defining a folding station S3 along path P.

For each spindle 9, unit 28 comprises a pusher 31 and a counter-pusher 32 aligned with each other and with respective spindle 9 on either side of the spindle, and respectively fitted to flange 17 and to flanges 13 and 14 so as to rotate with wheel 8 about axis 7. Each pusher 31 comprises a respective rod 33 parallel to axis 7 and presenting a respective tappet roller 34 which positively engages a groove 35 of a cylindrical cam 36 fitted to shaft 6 and inside appendix 16, and so formed as to move pusher 31 axially to and from a position in which it engages pocket 25 and spindle 9. Each counter-pusher 32 comprises a respective rod 37 parallel to axis 7 and presenting a respective tappet roller 38 which positively engages a groove 39 of a cylindrical cam 40 fitted to shaft 6 and inside appendix 15, and so formed as to move counter-pusher 32 axially to and from a position in which it engages pocket 24. Cam 40 presents a front wall facing flange 14, and which forms a face cam 41 with two annular grooves 42, 43 extending about axis 7, and the function of which is described later on.

Figure 3C:
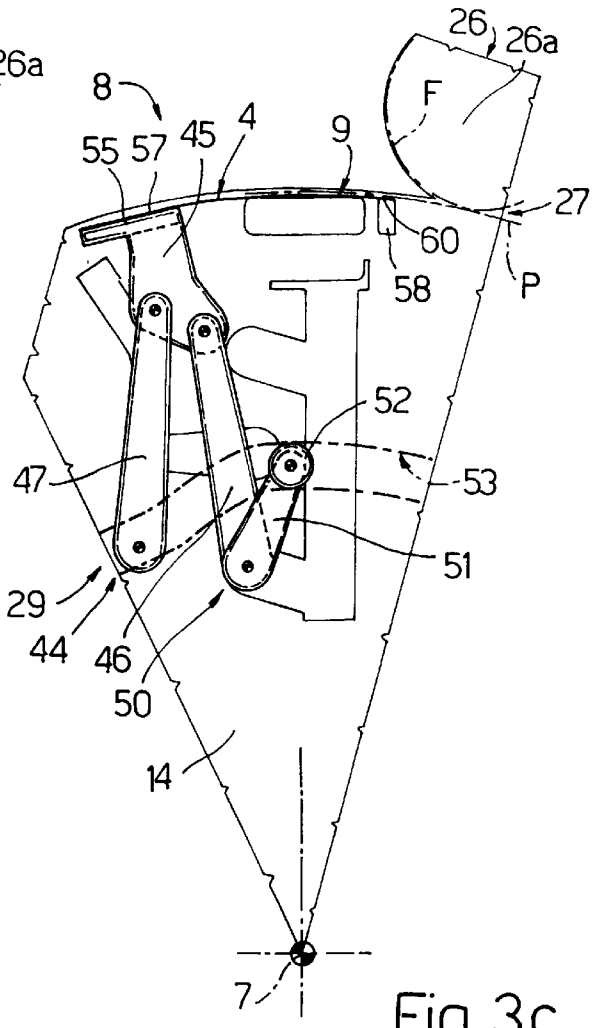
FIGS. 3A–3C shows three details of FIG. 1 in a given operating position.

As shown in FIG. 1 and particularly FIGS. 3 and 4, folding unit 29 comprises an articulated parallelogram pickup device 44, in turn comprising a connecting rod 45, and two cranks 46, 47 pivoting respectively at 48, 49 on wall 13*a* facing flange 14. Crank 46 forms one arm of a rocker arm 50, the second arm 51 of which extends inside chamber 13*b* and is fitted on its free end with a tappet roller 52 which positively engages an annular groove 53 of a face cam 54 fitted to shaft 6 inside chamber 13*b*. Connecting rod 45 is fitted with a suction plate 55 extending along connecting rod 45, presenting a number of external suction holes 56 associated with a known suction device (not shown), and which is positioned tangent to path F, and hence drum 26*a*, to pick up sheet 4 by the front end portion 57 of the sheet.

Pickup device 44 also comprises a suction supporting member 58 located behind spindle 9, and presenting a number of suction holes 59 connected to said suction device (not shown) to retain the rear end portion 60 of sheet 4. Member 58 cooperates with respective plate 55 to retain sheet 4 on the outer wall 61, located along path P, of spindle 9, and also provides for maintaining sheet 4 in the above position as plate 55 is shifted inside the space between two adjacent spindles 9 to partially fold sheet 4 squarely onto spindle 9 so that a front portion of sheet 4 is positioned substantially radially in relation to drum 11.

Folding unit 29 also comprises a retaining member 62 (FIG. 3*b*), in turn comprising a right-angle rocker arm 63 located between flanges 13 and 14 and fitted to flange 14 by a hinge pin 64 fitted through a respective hole 65 formed in flange 14. Rocker arm 63 comprises two arms 66, 67 substantially perpendicular to each other, the first of which is substantially L-shaped and fitted on its free end with a pad 68, and the second of which is fitted on its free end with a tappet roller 69. Pad 68 cooperates with respective spindle 9 to retain an intermediate portion of respective sheet 4 on the outer surface of the front lateral wall 70 of the rear spindle 9 in the pair of spindles 9 between which sheet 4 is folded by device 44; while roller 69 positively engages groove 42 of cam 41.

Folding unit 29 also comprises an articulated parallelogram device 71 (FIG. 3*a*), in turn comprising a connecting rod 72 positioned substantially radially in relation to drum 11, and two cranks 73, 74 pivoting respectively at 75 and 76 on flange 14, and for supporting and guiding connecting rod 72. Crank 73 forms one arm of a rocker arm 77, the second arm 78 of which extends on the opposite side of connecting rod 72 to crank 73, and is fitted on its free end with a tappet roller 79 positively engaging groove 43 of cam 41. Connecting rod 72 projects beyond the pivot connecting it to crank 74, and is fitted, on its free end facing respective spindle 9, with a substantially L-shaped, comb-like folding member 81 which cooperates with respective spindle 9 to fold sheet 4 onto the spindle.

Folding unit 30 comprises a comb-like plate 82 located in a fixed position along path P, downstream from station 27, and which provides for folding sheet 4 in a U about respective spindle 9, so that it contacts walls 61, 70 and the inner wall 61*a* opposite wall 61, with portions 57 and 60 parallel to each other and projecting from the rear of spindle 9.

Folding unit 30 also comprises a folding device 83 located radially outwards of drum 11 at plate 82, and presenting a number of combs 84 (two in the example shown), each of which is positioned substantially radially in relation to axis 7, is inserted inside the gap between member 58 and the rear wall 85 of spindle 9 to fold portion 60 squarely onto rear wall 85, and moves along and over plate 82. Combs 84 are moved successively by a pair of conveyor belts 86 looped about respective pulleys 87 and supporting combs 84 by means of respective pins 88 parallel to the axis of pulleys 87 and so connected to combs 84 as to keep them constantly parallel to themselves. Combs 84 are detached from rear wall 85 just before the arrival of folding members 81, each of which folds portion 57 squarely onto portion 60 to form a tubular wrapping 89 (FIG. 9*b*).

Figures 9A, 9B, 10A, 10B, 11A, 11B:
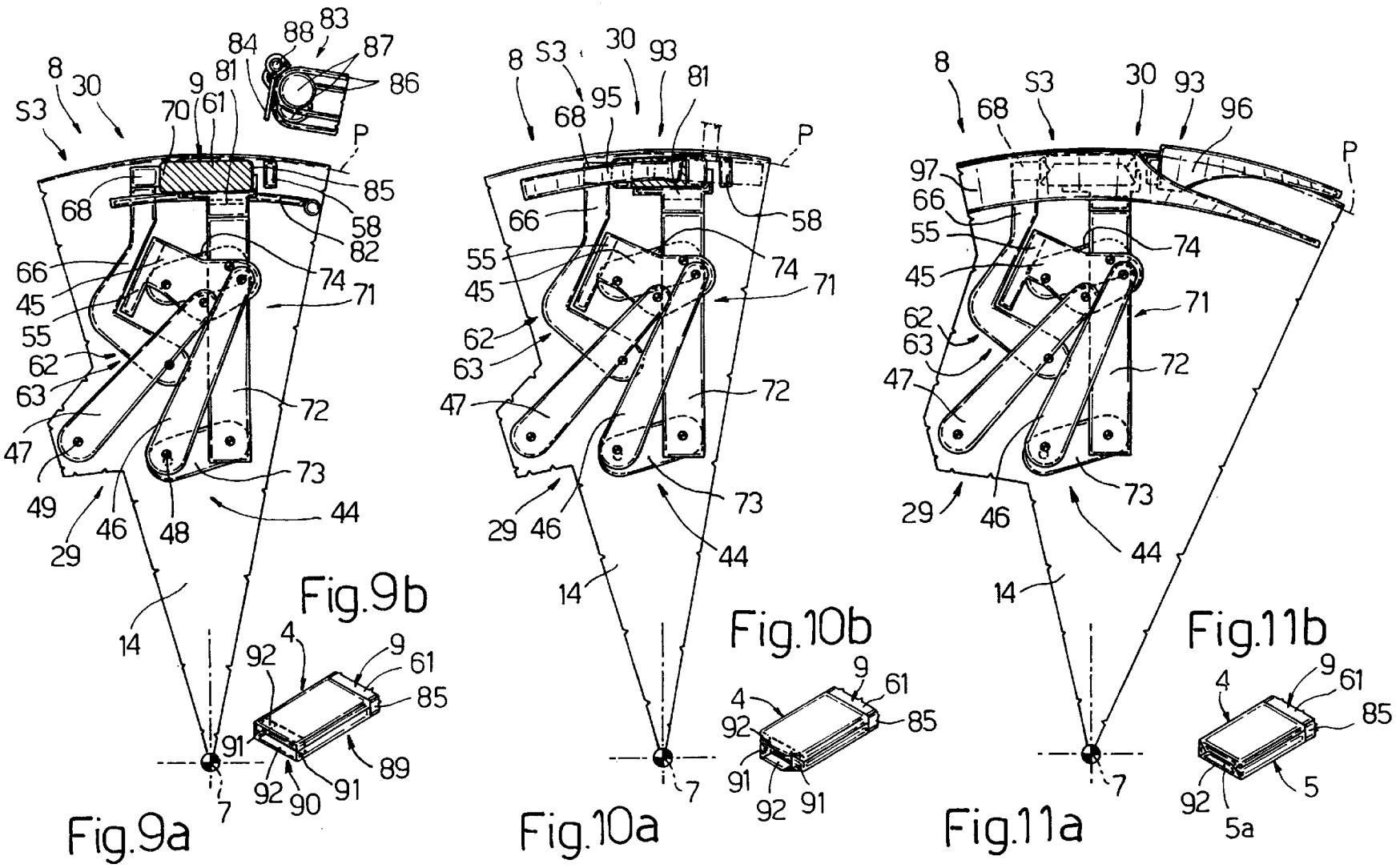

As shown in FIG. 9*b*, wrapping 89 presents an end 90 projecting axially from the end of spindle 9 facing flange 13, and presenting two facing radial tabs 91, and two facing tabs 92 perpendicular to tabs 91.

Folding unit 30 also comprises a further folding device 93 located along path P, downstream from plate 82, to the side of wheel 8 on the flange 13 side, and which provides for folding end 90 of each sheet 4 to form a respective cup-shaped wrapping 5, and comprises, in succession, a folding wheel 94, a fixed folding plate 95, and two known folding screws 96, 97.

In actual use, conveyors 18, 19 and wheel 8 feed respective pockets 24, 25 and spindles 9 continuously and at the same surface speed along path P, so that a pocket 24 and a respective pocket 25 and spindle 9 are maintained constantly aligned.

Operation of machine 1 will now be described with reference to one spindle 9, and as of the instant in which spindle 9, together with respective pockets 24 and 25, begins traveling along a portion of path P common to the path of pockets 25 and extending along station S1.

At this point, a transfer unit 28 transfers a group 2 of cigarettes 3 from the relative pocket 25 into spindle 9, while device 26 feeds a sheet 4 to station 27 so that at least a front portion of sheet 4, defined by portion 57, is positioned tangent to path P.

As plate 55 intercepts sheet 4 and retains portion 57 by suction, sheet 4 is deposited onto spindle 9 and is retained temporarily in this position by supporting member 58 (FIG. 4). Plate 55 is then moved along a trajectory T extending inside the space between two adjacent spindles 9, to fold sheet 4 squarely onto the front wall 70 of spindle 9 (FIG. 5).

Figure 3B:
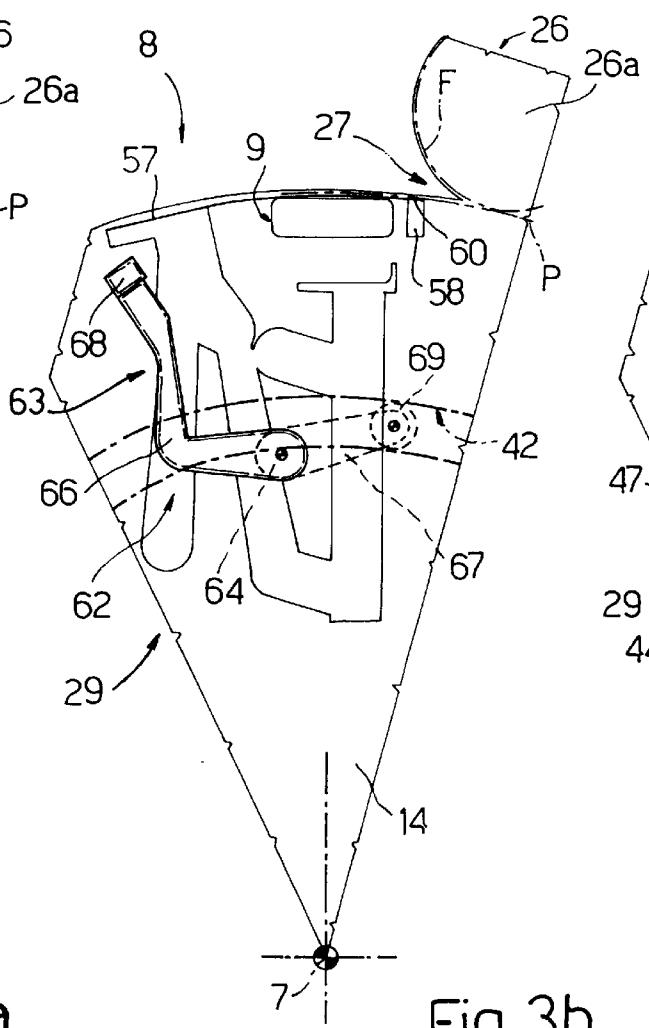
Figure 3A:
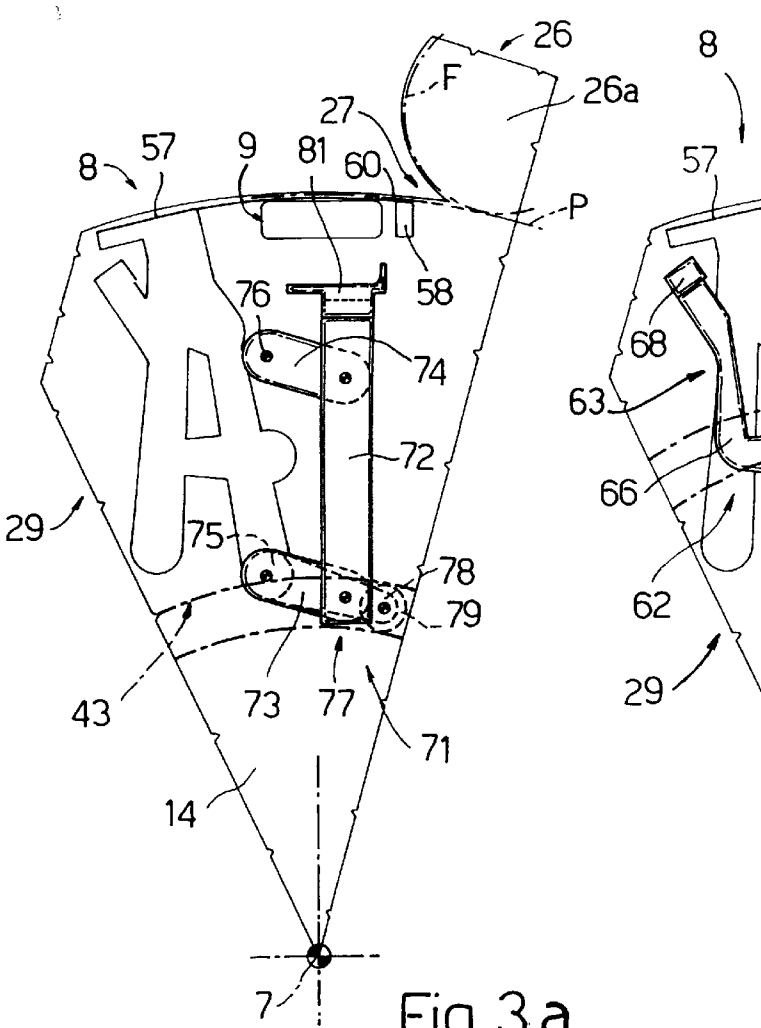

At this point, retaining member 62 is moved backwards in relation to wheel 8 by respective roller 69, and moves respective pad 68 up to spindle 9 so as to retain a central portion of sheet 4 on front wall 70 of spindle 9 (FIGS. 3*a* and 3*b*). At this point, wheel 8 moves spindle 9, together with respective pad 68, over plate 82 to fold sheet 4 in a U about spindle 9 (FIG. 7), while folding device 83 moves respective comb 84 to fold the free portion 60 of sheet 4 (FIGS. 8*a*, 8*b*) squarely onto the rear wall 85 of spindle 9.

Once portion 60 is folded, comb 84 is detached from spindle 9, which is then engaged by respective folding member 81 activated by respective connecting rod 72 in turn activated by respective roller 79. Folding member 81 folds portion 57 about spindle 9 and onto portion 60 to form wrapping 89 (FIGS. 9*a*, 9*b*).

At this point, wheel 8 feeds spindle 9, together with folding member 81 and pad 68, through folding device 93. More specifically, wheel 94 and plate 95 fold tabs 91 squarely towards each other (FIGS. 10*a*, 10*b*); and screws 96 and 97 then fold tabs 92 squarely towards each other to close wrapping 89 and form wall 5*a* of wrapping 5 (FIGS. 11*a*, 11*b*).

At this point, folding member 81 and pad 68 release spindle 9 to enable transfer unit 28 to transfer wrapping 5, together with group 2, from spindle 9 into relative pocket 24.

In connection with the above, it should be pointed out that sheet 4 is folded onto the outer surface of spindle 9 in such a manner that group 2 is never strictly required inside spindle 9. Group 2, in fact, may be inserted inside spindle 9 after wrapping 5 is completed, simply to enable wrapping 5 to be unloaded off spindle 9, and pusher 31 may be inserted inside wrapping 5 to act as a supporting body when folding end 90.

We claim:

1. A continuous cigarette packing machine (1) comprising a first rotary turret wrapping conveyor (8); a succession of wrapping spindles (9) fitted to the first rotary turret conveyor (8) and movable continuously with the first rotary turret conveyor (8) along a first given path (P); a continuously-moving second feed conveyor (19) for feeding a group (2) of cigarettes (3) to each said spindle (9) at a first transfer station (S1) along said first path (P); a feed device (26) for feeding each said spindle (9) with a sheet (4) of wrapping material along a second path (F) and at a second transfer station (27) along said first path (P); and pickup means (44) associated with each spindle (9), and for gripping a respective sheet (4) at said second transfer station (27); characterized in that said second path (F) extends tangentially to the first path (P) at the second transfer station (27); the feed device (26) comprising continuously-moving conveying means (26*a*) for feeding a succession of sheets (4) of wrapping material to said second transfer station (27) in time with the spindles (9) and along said second path (F) extending tangentially to said first path (P) of said spindles without extending into the plane of said first rotary turret wrapping conveyor (9) so as to feed said sheets (4) onto respective spindles (9); said pickup means (44) comprising gripping means (55) for gripping a respective sheet (4) of wrapping material, and actuating means (44, 50, 52, 53) connected to and for moving said gripping means (55) at least partly about the relative spindle (9); and a retaining member (62), fitted to the first rotary turret conveyor (8) and associated with each spindle (9), cooperating with an intermediate portion of the sheet (4) to retain it on the relative spindle (9) and on the first rotary turret conveyor (8).

2. A machine as claimed in claim 1, characterized in that said actuating means are so formed as to move the gripping means to and from a gripping position, wherein the gripping means are located along said first path (P), and along a trajectory (T) extending between two successive spindles, the rear spindle (9) of which is said relative spindle.

3. A machine as claimed in claim 2, characterized in that each said spindle comprises a first lateral wall substantially tangent to said first path (P); a second lateral wall parallel to said first wall (61); and a front wall and rear wall substantially crosswise to the first path (P); said trajectory (T) extending in front of said front wall; and said retaining member retaining said intermediate portion of the sheet on said front wall.

4. A machine as claimed in claim 3, characterized in that said conveying means are synchronized with said first rotary turret conveyor to feed a front portion of each sheet to said second transfer station in time with the relative gripping means (55); the first rotary turret conveyor presenting retaining means on the opposite side of each said spindle to the relative gripping means, for engaging and retaining a rear portion of each said sheet.

5. A machine as claimed in claim 4, characterized in that said retaining means are located along said first path (P).

6. A machine as claimed in claim 4, characterized in that said retaining means are suction retaining means.

7. A machine as claimed in claim 1, characterized in that said actuating means comprise an articulated parallelogram in turn comprising at least one crank and a connecting rod; and cam means for controlling rotation of said crank; said gripping means being fitted to said connecting rod.

8. A machine as claimed in claim 3, characterized in that it also comprises first fixed folding means for intercepting said trajectory (T) and folding each said sheet substantially in a U onto said second lateral wall of the relative spindle.

9. A machine as claimed in claim 8, characterized in that it also comprises first and second movable folding means cooperating successively with two end portions of each sheet projecting from the rear of the relative spindle, and for folding said end portions squarely onto the rear wall of the spindle to form a tubular wrapping presenting at least one end projecting axially from the relative spindle.

10. A machine as claimed in claim 9, characterized in that said first movable folding means are fitted to said first rotary turret conveyor and associated with each said spindle.

11. A machine as claimed in claim 10, characterized in that said first movable folding means comprise an L-shaped member; and actuating means for moving said L-shaped member to and from a position contacting said second lateral wall and said rear wall of said relative spindle.

12. A machine as claimed in claim 9, characterized in that said second movable folding means are located in a fixed position along said first path (P), and cooperate successively with said sheets to fold a said rear portion of the sheet onto the rear wall of said relative spindle.

13. A machine as claimed in claim 12, characterized in that said second movable folding means comprise a number of folding means for folding respective said rear portions; and conveyor means connected to and for moving said folding means parallel to themselves and inside the gap between said spindle and the respective said retaining means.

14. A machine as claimed in claim 13, characterized in that said conveyor means comprise a pair of conveyor belts looped about respective offset, side by side pulleys; each said folding means being defined by a comb fitted to said pair of conveyor belts.

15. A machine as claimed in claim 9, characterized in that it also comprises further folding means located in a fixed position along said first path (P) and cooperating successively with said sheets to fold the relative said end.

16. A machine as claimed in claim 1, characterized in that it comprises a continuously-moving third output conveyor for receiving a group of cigarettes, together with a respective wrapping, from each said spindle at a third transfer station (S2) along said first path (P).

17. A machine as claimed in claim 16, characterized in that said second and third conveyors are endless conveyors, each of which comprises a respective belt looped about respective pulleys; one pulley (23) of the second conveyor and one pulley of the third conveyor presenting a common axis.

18. A machine as claimed in claim 17, characterized in that said first rotary turret conveyor comprises a wrapping wheel coaxial with said common axis.

19. A machine as claimed in claim 18, characterized in that said wrapping wheel comprises a central drum coaxial with said axis; the drum comprising two circular elements respectively supporting said pulley of the third conveyor and said pulley of the second conveyor.

* * * * *

UNITED STATES PATENT AND TRADEMARK OFFICE

CERTIFICATE OF CORRECTION

PATENT NO. : 5,806,289

DATED : September 15, 1998

INVENTOR(S) : Fabio Sassi, et al.

It is certified that error appears in the above-identified patent and that said Letters Patent is hereby corrected as shown below:

Title page;
[73] change "G.D Societa' Per Azinoni, Bologna, Italy" to --G.D Societa' Per Azioni, Bologna, Italy--

Signed and Sealed this

Ninth Day of February, 1999

*Attest:*

*Attesting Officer*

*Acting Commissioner of Patents and Trademarks*